US005211244A

United States Patent [19]

Arterbury

[11] Patent Number: 5,211,244

[45] Date of Patent: May 18, 1993

[54] APPARATUS AND METHOD FOR CONTAINING FLUIDS AROUND A WELLHEAD

[75] Inventor: Roy S. Arterbury, Houston, Tex.

[73] Assignee: The Cavins Corporation

[21] Appl. No.: 726,025

[22] Filed: Jul. 5, 1991

[51] Int. Cl.[5] ..... E21B 19/00

[52] U.S. Cl. ..... 166/379; 166/81

[58] Field of Search ..... 166/75.1, 81, 84, 88, 166/95; 277/18, 10, 17, 21; 405/60, 63; 175/52, 85

[56] References Cited

U.S. PATENT DOCUMENTS

| | | | |
|---|---|---|---|
| 113,638 | 4/1871 | Dewey | 166/81 |
| 1,105,340 | 7/1914 | Rigby | 166/88 |
| 1,334,678 | 3/1920 | Riley | 166/75.1 |
| 1,507,628 | 9/1924 | Schuyler | 166/88 |
| 2,527,255 | 10/1950 | Hunt | 175/52 |
| 3,186,722 | 6/1965 | Johnston | 166/84 |
| 3,747,695 | 7/1973 | Branham | 175/52 |
| 4,224,985 | 9/1980 | Rapson | 166/75.1 |
| 4,673,034 | 6/1987 | Hansen | 166/75.1 |
| 4,901,805 | 2/1990 | Ali-Zade et al. | 175/52 |
| 5,098,220 | 3/1992 | Norman | 166/81 |

*Primary Examiner*—Terry Lee Melius
*Assistant Examiner*—Frank S. Tsay
*Attorney, Agent, or Firm*—Bush, Moseley & Riddle

[57] ABSTRACT

A portable apparatus and method for catching and containing fluids leaked from a wellhead (10) of an oil and gas well including a tank structure (32) having a pair of tank sections (34, 36) interconnected in surrounding relation about the wellhead (10) to catch and contain fluids from the wellhead (10). An apron or skirt (64) is secured about the wellhead (10) to deflect fluids into the tank sections (34, 36). A pipe support or rack (68) is positioned in one of the tank sections (36) and a splash board (72) is detachably connected to the tank section (36) adjacent the pipe support (68) to deflect fluids from lower open ends of pipe sections (70) being removed from the well. The tank structure (32) is portable and utilized with a well rig (20) beneath the rig platform (22) extending over the well and the tank sections (34, 36) are arranged to fit within each other for easy transport.

32 Claims, 3 Drawing Sheets

FIG. 3
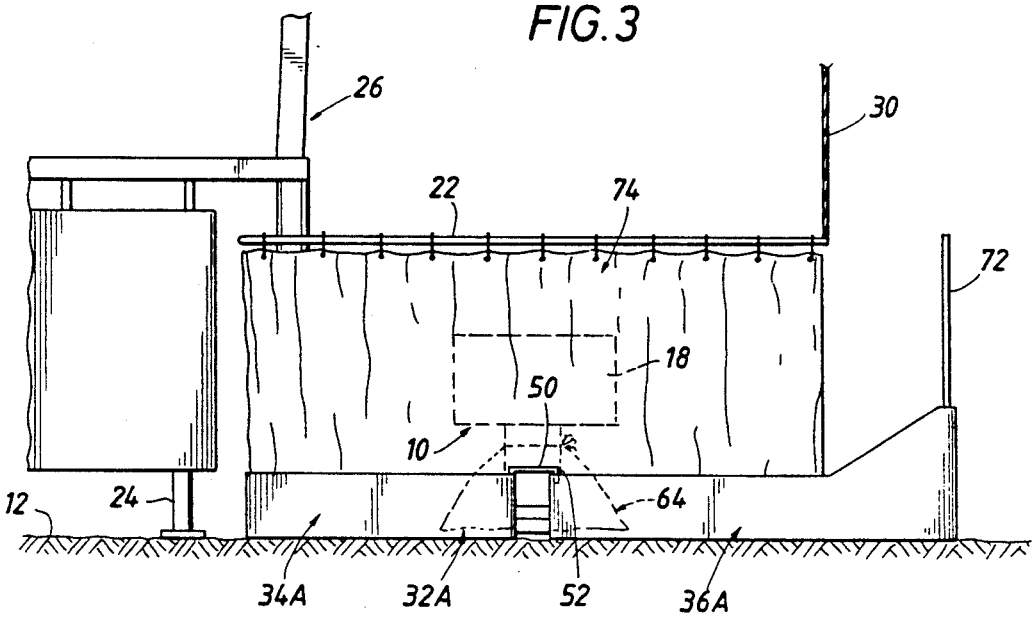
FIG. 5
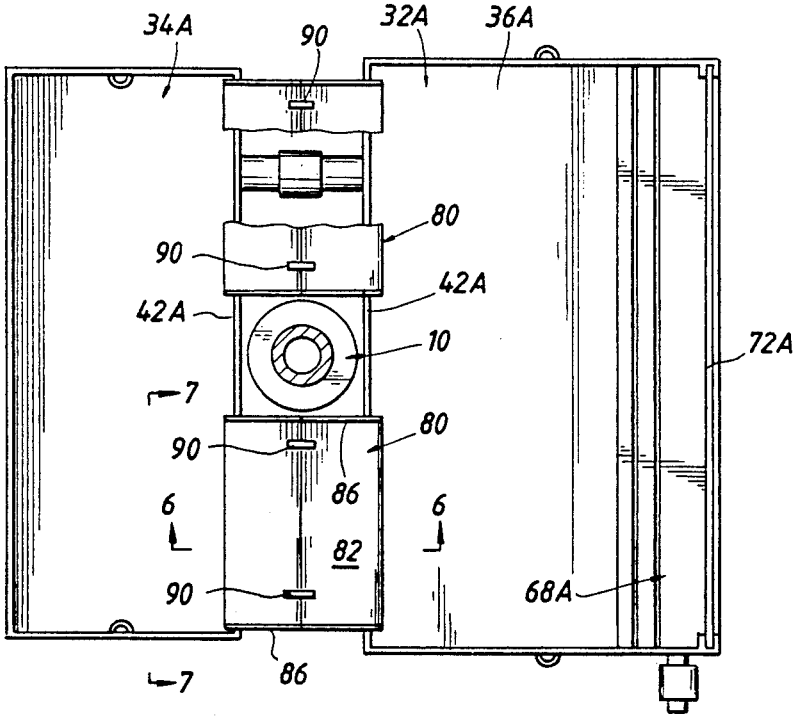
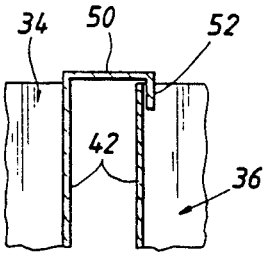
FIG. 4
FIG. 6
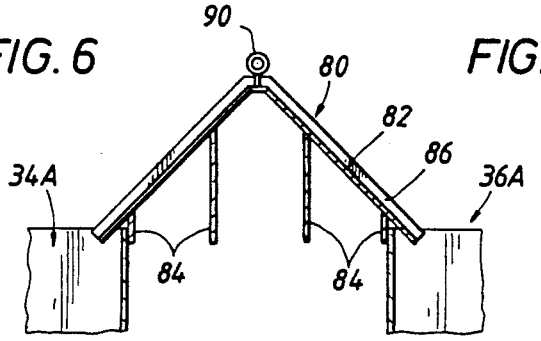
FIG. 7
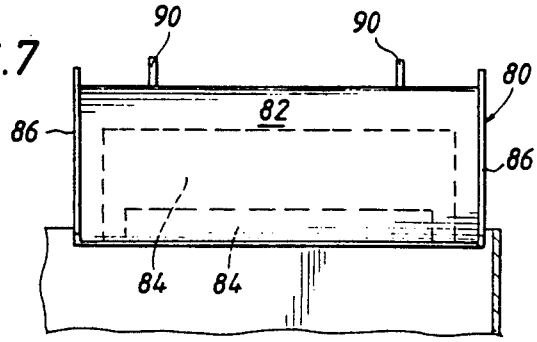

APPARATUS AND METHOD FOR CONTAINING FLUIDS AROUND A WELLHEAD

FIELD OF THE INVENTION

This invention relates to a portable apparatus and method for catching and containing fluid about a wellhead of an oil or gas well, and more particularly to such a portable apparatus and method utilized with a workover or drilling rig in a workover or drilling operation.

BACKGROUND OF THE INVENTION

It is common practice in the oil and gas industry to have some leakage or spillage of drilling and workover fluids, such as oil, saltwater, sand, or mud, for example, from the wellhead or rig floor. Such fluids create possible safety or environmental hazards. Thus, it is highly desirable to collect or contain such fluids at the wellhead in order to prevent or minimize such hazards.

Heretofore, oil and gas producers have oftentimes built permanent open cement pits or cellars below ground around wellheads for collecting fluids during workover or drilling operations. In such workover or drilling operations where production or drill pipe is pulled from a well, fluid is prevalent in or on the pipe. Where a cement pit exists, this fluid drains into the pit and does not contaminate the ground around the wellhead. However, where such a permanent pit does not exist, the fluid is free to drain upon the ground.

As shown in U.S. Pat. No. 4,949,784 dated Aug. 21, 1990, a tank is provided to catch and contain fluids leaked from around a polished rod of a producing well. The tank is not adapted for use with a drilling or workover rig in which the tank is adapted to support pipe sections therein removed from a well and to contain the fluid leaked from the pipe sections.

As shown in U.S. Pat. No. 4,429,754 dated Feb. 7, 1984, a container and conveyor apparatus is shown to carry drill bit cuttings from around a borehole during drilling operations. The apparatus is not portable for moving from one site to another site with a drilling or workover rig and does not have a pipe support therein for supporting pipe sections removed from the wellhead.

SUMMARY OF THE INVENTION

The present invention is particularly adapted for utilization with a drilling or workover rig and is easily erected and disassembled for transport from one site to another site with the rig. The portable apparatus for receiving and containing the fluid is easily fitted about a wellhead and minimizes the leakage or draining of any fluid from the working floor or platform of the rig. The portable apparatus is positioned about and surrounds the wellhead beneath the rig floor and surface valves. The apparatus is particularly designed to be easily placed in position about the wellhead by lift means of the associated rig or a pole type winch truck. Pipe sections pulled from the well normally have fluids draining from the lower open ends of the pipe and such fluids provide a major source of contamination. Pipe sections are normally stacked in a vertical relation on pipe racks upon removal from the well and the present apparatus is designed to support the pipe rack so that any fluid from the removed pipe sections is drained into a storage tank of the apparatus. Also, a so-called splash board is provided by the present apparatus and extends vertically from the storage tank alongside the pipe rack in order to deflect any fluid from the pipe downwardly for draining into the storage tank.

Also, a waterproof skirt or hood is preferably positioned about the wellhead below the blowout preventers (BOP) and a drawstring or elastic member about the upper end of the skirt provides a seal between the wellhead and the skirt. The skirt acts as a deflector to direct all fluid draining from the wellhead into the tank. Waterproof curtains may also be hung from the rig floor for extending downwardly to the tanks to prevent splashing of fluid outside the tank onto the ground.

The portable apparatus is specifically formed of a plurality of sections so that it can be easily disassembled and assembled about a wellhead and may be adapted for utilization about wellheads and rigs of different sizes and for various sites. Normally the apparatus will include two or more tanks for containing the fluids and in that event a drain is provided between the tanks so that the fluid in all of the tanks is of the same level. Tanks will normally be provided with reinforcements on their bottoms so that the tanks may be moved along the ground and lift rings or brackets are provided at selected portions along the upper edges of the tank to allow the tank to be easily lifted by the associated rig. The rig normally has supporting legs and two of the legs of the rig are normally positioned within a tank for support therein along one side of the apparatus generally in opposed relation to the side of the apparatus having the pipe rack supported therein. The apparatus has a suitable drain valve and line so that fluid within the tanks may be drained or pumped into a larger holding tank. A vacuum truck or small pump may also be utilized in order to remove collected fluids from the tanks.

It is an object of this invention to provide a portable apparatus for catching and containing fluids about a wellhead of an oil and gas well and utilized in combination with a workover or drilling rig in a workover or drilling operation with the apparatus surrounding the wellhead and collecting fluids leaking therefrom.

An additional object of the invention is to provide such a portable apparatus including a collecting tank structure fitting about the wellhead with a removable skirt about the wellhead above the tank structure to deflect and direct fluids into the collecting tank structure.

A further object of this invention is to provide such an apparatus supporting a pipe rack therein with a splash board adjacent the pipe rack so that fluids from pipe sections removed from the well and placed on the pipe rack will be deflected by the splash board into the storage tanks.

Another object of this invention is to provide a method for catching and containing fluids about a wellhead of an oil and gas well including the steps of positioning a plurality of removable sections in surrounding relation about a wellhead including a fluid collecting tank to receive the leaked fluids, and then positioning a skirt about the wellhead above the tank to deflect fluid into the tank.

Other objects, features, and advantages of this invention will become apparent after referring to the following specification and drawings.

BRIEF DESCRIPTION OF THE DRAWINGS

FIG. 3 is an elevation looking generally along line 3—3 of FIG. 2 and showing in elevation the apparatus in position about a wellhead with a skirt extending between the wellhead and the receiving and collecting tanks for the fluids;

FIG. 4 is a partial section along line 4—4 of FIG. 2 showing the connecting joint between the adjacent tank sections to adapt the apparatus for fitting about wellheads of different sizes;

FIG. 5 is a top plan of a separate embodiment of the present invention showing a pair of end connecting covers between a pair of tanks for removably connecting the tanks to each other and providing means for deflecting fluids leaked from the wellhead into the tanks;

FIG. 6 is an enlarged section taken along line 6—6 of FIG. 5 and showing an end cover in section;

FIG. 7 is a view looking generally along line 7—7 of FIG. 5 and showing the end cover in elevation;

DESCRIPTION OF THE INVENTION

Figure 1:
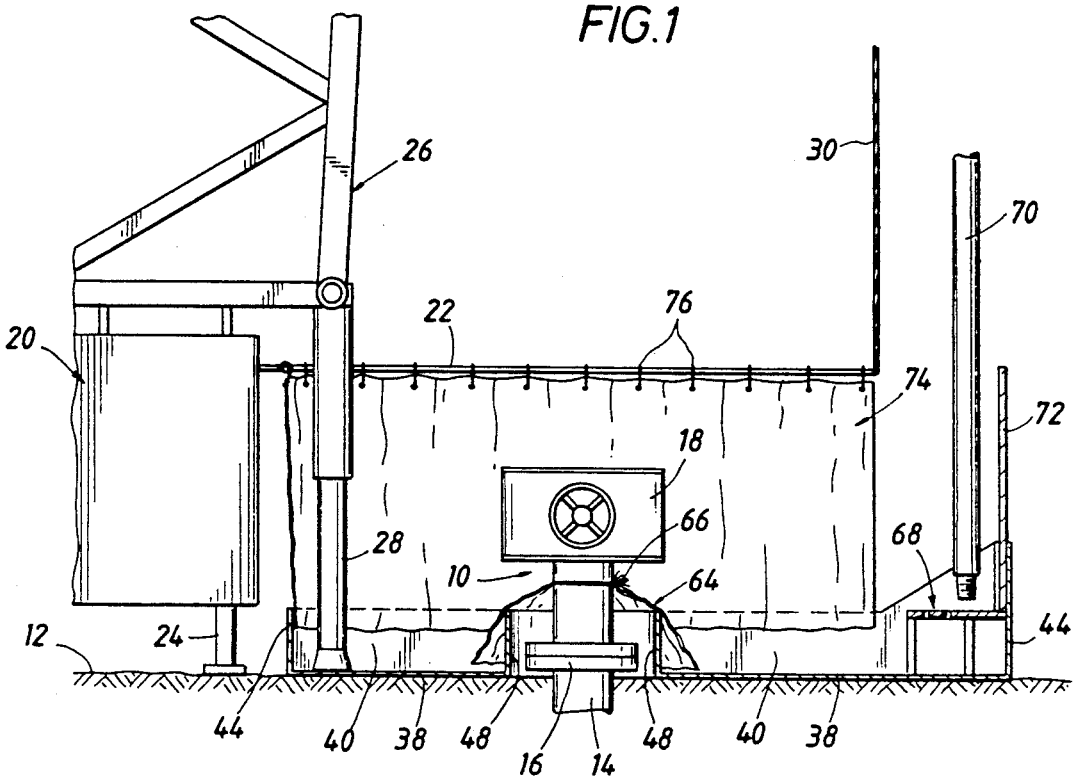
FIG. 1 is a side elevation, partly schematic, of a workover rig and wellhead with the apparatus comprising the present invention in position surrounding the wellhead.

Referring now to the drawings for a better understanding of this invention, and more particularly to the embodiment shown in FIGS. 1-4, a wellhead is shown generally at 10 at a site of an oil or gas well with the ground level indicated at 12. Surface valves, such as gate valves, are shown at 13 connected to wellhead 10, and various flowlines, not shown, may extend from at least some of the surface valves. A well casing for the well is shown at 14 and has an upper flange 16 for attachment of a suitable Christmas tree or other surface valves to control the flow of fluids from the well. A blowout preventer (BOP) is provided over the surface valves and at times may be removed for access to the downhole casing for workovers and the like.

A drilling rig is utilized during initial drilling of the well and a workover rig is utilized for operations such as completion and workover operations after production is commenced. The present invention is particularly adapted for use with either a drilling rig or a workover rig and is directed to apparatus for catching and containing fluids leaked from wellhead 10 during drilling or workover operations.

A workover rig is shown schematically in FIG. 1 as a trailer mounted rig generally indicated at 20 having a rig platform or floor 22 and retractable legs 24. A derrick generally indicated at 26 is mounted over platform 22 and wellhead 10 and has extensible legs 28 for support of the derrick for the drilling or workover operations. An outer support 30 for platform 22 extends upwardly to the derrick to support platform 22 on which workmen are supported for the drilling or workover operations. Fluids from the wellheads, such as oil, drilling fluids, sand, or other debris spill or leak from the wellhead from various sources, such as the drill pipe removed from the well, the surface valves, and water from washing the platforms.

Referring now to the specific embodiment shown in FIGS. 1-5, the apparatus for catching and containing fluid leaked from wellhead 10 comprises a tank structure generally indicated at 32 including a pair of parallel elongate tank sections indicated generally at 34 and 36. Each tank section 34, 36 has a horizontal bottom 38 and connecting vertical sides defining end sides 40 and respective inner and outer sides 42 and 44 thereby to provide open containers for collecting and containing fluids.

Figure 2:
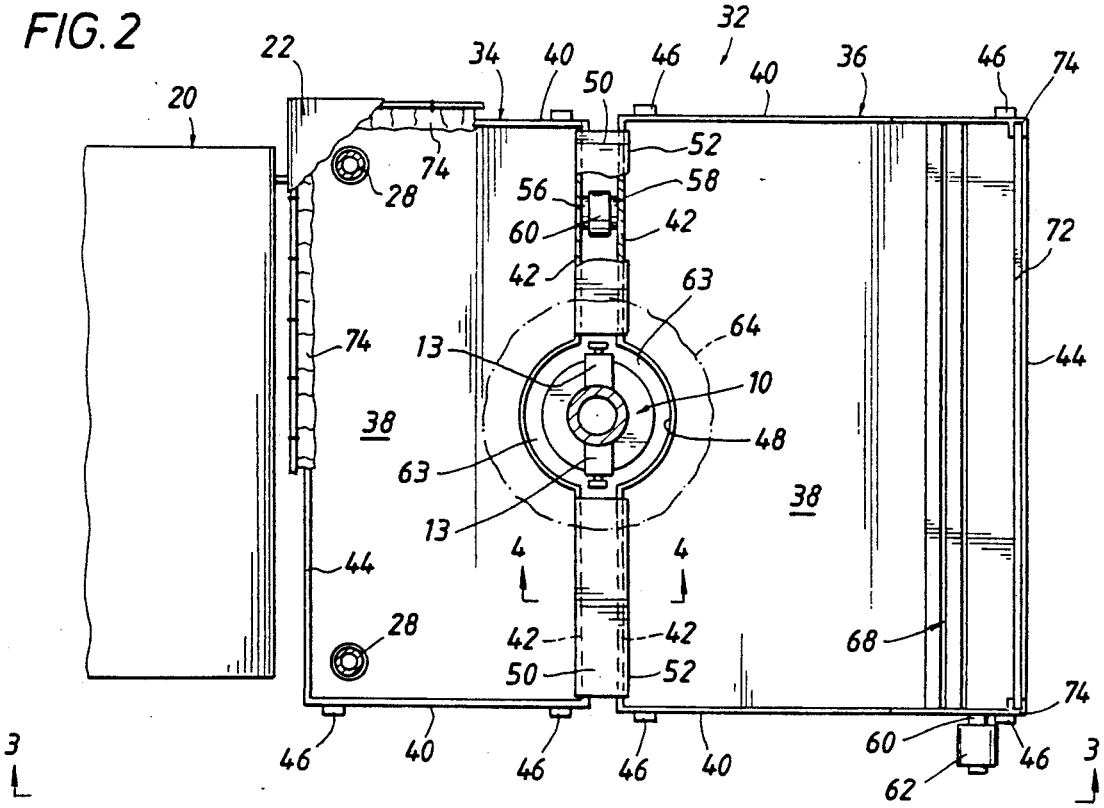
FIG. 2 is a top plan view of the apparatus shown in FIG. 1 about the wellhead for collecting and containing fluids leaked from the wellhead.

Lift brackets or rings 46 are provided adjacent the upper corners of tank sections 34 and 36 and have eyes for connection to hooks on suitable cables for lifting by derrick 26 or other lifting means, such as a winch. Inner sides 42 have a semi-circular portion 48 as shown in FIG. 2 for receiving wellhead 10. While an equal spacing is shown between inner sides 42 of tank sections 34, 36 it may be desirable to have different spacings between inner sides 42 of sections 34 and 36 on opposite sides of wellhead 10 in order to accommodate flow lines (not shown) extending from one side of the wellhead which would have control valves thereon.

In order to permit tank sections 34, 36 to surround wellhead 10, and to adapt tank sections 34, 36 for fitting about wellheads of varying diameters, the inner side 42 of tank section 34 except for cutout portion 48 has an upper horizontal flange 50 extending outwardly over inner side 42 of tank section 36 and a lip or downwardly extending flange 52 which overlaps inner side 42 of tank section 36 as shown in FIG. 4. The outwardly extending horizontal flange 50 may be of a substantial width, such as around one foot, for example, in order to permit tank sections 34 and 36 to accommodate wellheads of various diameters.

In order to permit fluid flow between tank sections 34 and 36, a removable conduit 56 may be threaded onto a suitable opening in tank section 34 and a conduit 58 may be threaded into a suitable opening in tank section 36 with a removable coupling 60 connecting the two conduit sections 56 and 58 to each other in a fluid tight relation. Also, a suitable drain conduit shown at 60 may be provided having a suitable control valve 62 therein movable between open and closed positions to permit draining or removal of the fluids within tank sections 34 and 36.

Normally, an annular clearance or space 63 is provided between wellhead 10 and tank sections 34 and 36. To prevent or minimize any fluid leakage from wellhead 10 from leaking or spilling into this clearance, a waterproof apron or skirt shown generally at 64 in FIG. 1 extends between wellhead 10 and tank sections 34 and 36 to cover clearance 63 and to deflect fluids from wellhead 10 into tank sections 34 and 36. Apron 64 may be provided with a zipper to permit easy assembly about wellhead 10 and a drawstring or elastic upper end 66 for securely fitting about wellhead 10.

Mounted within tank section 36 is a pipe support or rack generally shown at 68 for supporting pipe sections as illustrated at 70 upon removal of the pipe sections from the well as might be required for changing of a drill bit or the like during the drilling operation. The lower open ends of pipe sections 70 where are normally around 40 feet in length leak wellhead fluids and such fluids will leak into tank section 36 below pipe rack 68. Further, to deflect any wellhead fluids spilled from the lower ends of pipe sections 70, a removable splash board shown generally at 72 inside tank section 36 behind pipe rack 68 is removably inserted within brackets 74 secured to outer side 44 of tank section 36. Thus, fluid drained against drain board 72 will be deflected downwardly into tank section 36. The pipe support merely supports the lower ends of pipe sections removed from the well and may be formed of various materials or designs. In some instances, wooden timbers such as railroad cross ties could be positioned within tank section 36 to support the ends of the pipe sections and thus would form the pipe support.

For the remaining three sides of tank structure 32, waterproof splash curtains 74 are suspended from rig platform 22 by suitable hooks 76 and extend downwardly therefrom to tank sections 34 and 36. Splash curtains 34 likewise deflect fluids from the drilling or workover operations at wellhead 10 downwardly into tank sections 34 and 36.

Tank section 34 is adapted to receive and support retractable legs 28 of derrick 26 therein as shown in FIG. 2. Reinforcing of bottom 38 of tank section 34 may be provided to provide adequate strength to support legs 28.

In order to facilitate the assembly, disassembly, and transport of tank structure 32, tank section 34 has a width and length smaller than the width and length of tank section 36 as shown in FIG. 2 in order for tank section 34 to fit within tank section 36. Tank section 34 may be easily lifted by derrick 26 from cables connected to brackets 46 and then lowered within tank section 36. Then, tank section 36 may be easily lifted by cables from derrick 26. Thus, a portable apparatus has been provided associated with a well rig 20 which may be transported with rig 20 from one well site to another well site. If desired to empty tank sections 34 and 36 of fluids, fluid may be pumped or drained from conduit 60 into a larger holding tank adjacent the well site upon opening of valve 62 and connection of a suitable drain hose or the like to valve 62. Also, a vacuum truck or small pump may be utilized to remove fluids by placing a vacuum hose within tank sections 34 and 36. Tank sections 34 and 36 are preferably formed of a sheet metal material and reinforced by I-beam reinforcements of sufficient strength to support legs 28 of derrick 26 and pipe rack 68 in addition to the weight of the fluids. The weight of the derrick legs may be over 100,000 pounds, for example.

If desired it is apparent that tank sections 34 and 36 could be rotated 90° from the plan shown in FIG. 2 so that the sections extend longitudinally from the rig instead of transversely to the rig as shown in FIG. 2.

Referring now to FIGS. 5-7, a separate embodiment of the tank structure is illustrated in which the tank structure or assembly 32A includes a pair of tank sections 34A and 36A with a pipe rack 68A and splash board 72A being provided for tank section 36A. Tank sections 34A and 36A are of a rectangular configuration and do not have any indentations therein to receive wellhead 10 as in the embodiment of FIGS. 1-4. Inner sides 42A extend the length of tank sections 34A and 36A. For connecting tank sections 34A and 36A to each other for surrounding wellhead 10, separate end cover sections shown generally at 80 are provided to span the spacing or clearance between tank sections 34A and 36A. Each end cover section 80 comprises an inverted V-shaped top or cover 82 having a plurality of guide plates 84 extending downwardly therefrom and adapted to fit alongside inner sides 42A of tank sections 34A and 36A. Thus, the plurality of guide plates 84 permit end cover sections 80 to be adaptable for wellheads 10 of variable diameters and different spacings between tank sections 34A and 36A. End flanges 86 extend along the ends of V-shaped cover 82 and extend upwardly from cover 82 to direct fluid runoff or flow into tank sections 34A and 36A. A pair of lift brackets or eyes 90 are mounted on cover 82 to permit lifting of covers 80 by cables or the like. Tank structure 32A is utilized in a manner similar to that of tank structure 32 of the embodiment shown in FIGS. 1-4.

Figure 8:
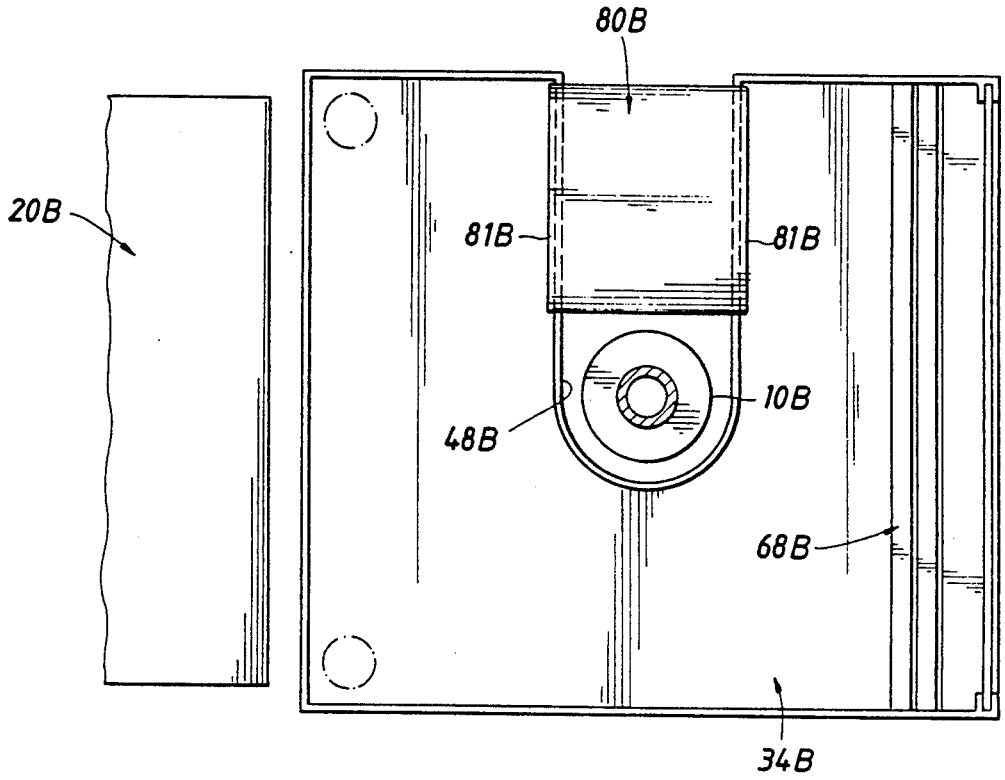
FIG. 8 is a plan view of a further embodiment of this invention in which a single tank has an opening to receive the wellhead therein and a cover is then positioned over the opening.

Referring to FIG. 8, another embodiment of the tank structure is illustrated in which a single tank section 34B is provided having an elongate opening or slot 48B to receive the wellhead shown at 10B. A cover 80B of a generally channel-shape is positioned over the opposed sides of tank section 34B with legs 81B of cover 80B extending downwardly alongside the adjacent opposed sides of tank section 34B. A suitable pipe support 68A is positioned within tank section 34B on the side thereof opposite the rig shown generally at 20B. Under certain conditions, it may be desirable to insert a separate tank within opening 48B instead of cover 80B.

Figure 9:
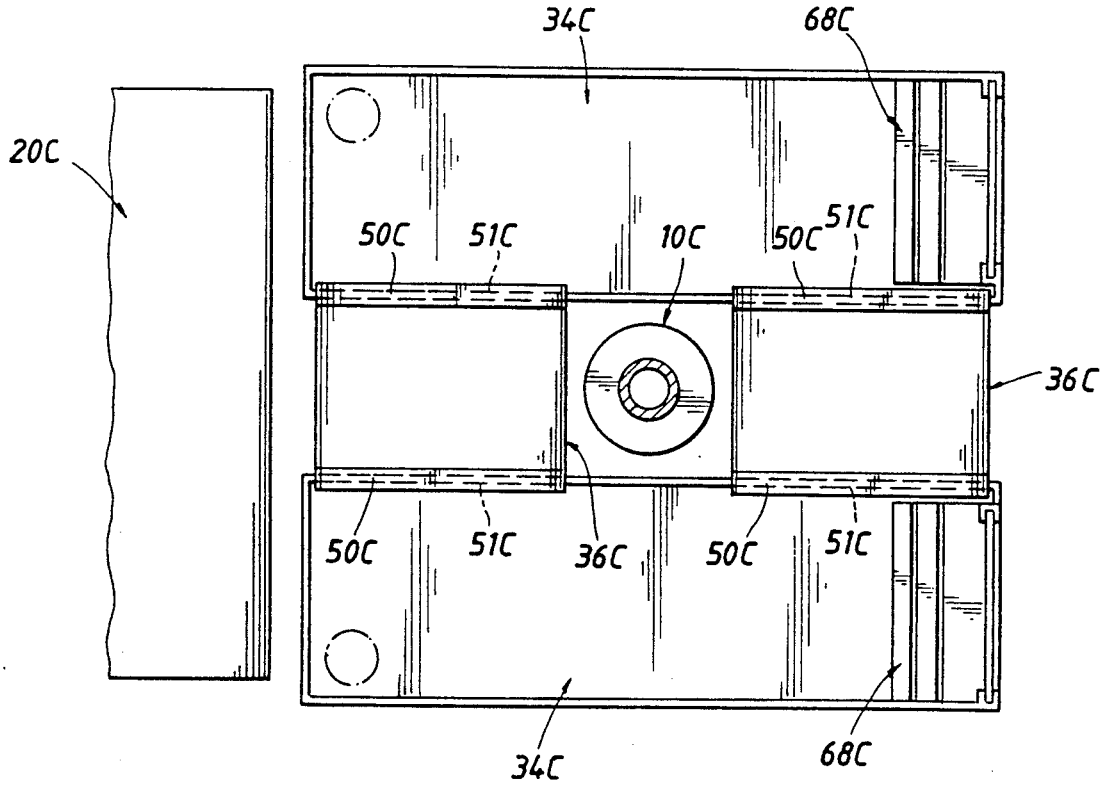
FIG. 9 is a plan of an additional embodiment of this invention in which the tank structure includes four separate tank sections with two tank sections positioned between a pair of parallel sections.

Referring to FIG. 9, an additional embodiment of the tank structure is shown in which a pair of elongate tank sections 34C are positioned in parallel relation to wellhead 10C and spaced from each other. A pair of interfitting tank sections 36C are positioned between tank sections 34C adjacent wellhead 10C. Interfitting tank sections 36C have upper angle-shaped extensions 50C for fitting over the sides of the adjacent tank section 34C. Downwardly extending legs 51C of angle-shaped extension 50C extend downwardly alongside the adjacent opposed sides of tank sections 34C. Pipe supports 68C are provided in each parallel tank section 34C on sides thereof opposite rig 20C.

It is to be understood that the separate embodiments shown in FIGS. 5-7, FIG. 8, and FIG. 9 are similar to the embodiment of FIGS. 1-4 except for the differences in the tank structure and would include a similar splash board and apron, for example, as shown in the embodiment of FIGS. 1-4.

From the above, it is apparent that the tank structure of the present invention may be provided in a variety of embodiments and yet accomplish the function of the present invention. For example, connecting tank sections adjacent the wellhead positioned between parallel tank sections could be made, for example, of telescoping portions in order to vary the spacing between parallel tank sections for accommodating wellheads of different diameters, for example.

While several embodiments of the present invention have been illustrated in detail, it is apparent that modifications and adaptations of the embodiments shown will occur to those skilled in the art. However, it is to be expressly understood that such modifications and adaptations are within the spirit and scope of the present invention as set forth in the following claims.

What is claimed is:

1. Apparatus associated with an oil and gas well rig for catching and containing leaked fluids from a wellhead comprising:

a tank structure surrounding the wellhead at a location beneath the rig platform to receive fluids leaked from the well and having a portion positioned adjacent the rig, said tank structure having a bottom on a supporting ground surface and a plurality of connected sides extending upwardly from the bottom;

a pipe support for pipe sections removed from the well positioned within the tank structure above the bottom and below the upper ends of said sides, said pipe support being adjacent a side of the tank structure opposite the well rig to support pipe sections removed from the well; and a splash board extending from the tank structure on the side thereof adjacent said pipe support for deflecting fluids draining from the lower open ends of the pipe sections into the tank structure.

2. Apparatus as set forth in claim 1 wherein said tank structure comprises two tank sections detachably connected to each other on opposed sides of the wellhead, one of said sections having said pipe support therein and the other of said tank sections adapted to receive and support legs of the well rig therein.

3. Apparatus as set forth in claim 1 wherein said tank structure includes a tank to receive and contain fluid therein, and a waterproof skirt is removably connected in surrounding relation to the wellhead above said tank and slopes downwardly to said tank to direct fluid to said tank from said wellhead.

4. Apparatus as set forth in claim 1 wherein said tank structure comprises two removably connected tank sections, one of said tank sections being of dimensions smaller than the dimensions of the other tank section and adapted to fit within said other tank section for transport.

5. Apparatus as set forth in claim 1 wherein said rig has a platform over the wellhead and a vertically extending waterproof splash curtain extends downwardly from said rig platform adjacent a side of said tank structure to deflect fluid downwardly within said tank structure.

6. Apparatus as set forth in claim 1 wherein said tank structure include a plurality of tank sections, and lifting brackets are provided on said tank sections to permit lifting of said tank sections by said well rig.

7. Apparatus associated with an oil and gas well rig for catching and containing leaked fluids from a wellhead, said rig having a platform and a derrick with extensible legs for supporting the derrick; said apparatus comprising:

a tank structure surrounding the wellhead at a location beneath the rig platform to receive fluids leaked from the well and having a portion positioned adjacent the rig, said tank structure having a bottom on a supporting surface and a plurality of connected sides extending upwardly from the bottom;

a pipe support mounted within said tank structure adjacent one side thereof with said extensible legs of said derrick being mounted within said tank structure adjacent an opposite side thereof; and a waterproof skirt removably connected in surrounding relation to the wellhead about said tank structure and sloping downwardly to the tank structure to direct fluids to said tank structure from said wellhead.

8. Apparatus as set forth in claim 7 wherein said tank structure comprises a pair of generally parallel tank sections removably connected to each other on opposed sides of said wellhead, and a fluid conduit between the tank sections to permit the flow of fluid therebetween.

9. Apparatus as set forth in claim 8 wherein one of said tank sections is of dimensions smaller than the dimensions of the other tank section and adapted to fit within said other tank section for transport.

10. Apparatus as set forth in claim 7 wherein a splash board is removably mounted on the side of said tank structure adjacent said pipe support to deflect fluids from the lower open ends of pipe sections being removed from the well.

11. A tank structure for receiving and containing leaked fluids from a wellhead having a well rig positioned adjacent the wellhead; said tank structure comprising:

at least a pair of generally parallel portable tank sections of a generally rectangular shape positioned on opposed sides of said wellhead, each tank section having a bottom on a supporting ground surface and four connected sides extending upwardly from said bottom; and means detachably connecting said tank sections to each other for surrounding said wellhead.

12. A tank structure as set forth in claim 11 wherein a pipe support is positioned within one of said tank sections, and a splash board is removably connected to said one tank section adjacent said pipe support to deflect fluids from the lower open ends of pipe sections removed from the well downwardly into said one tank section.

13. A tank structure as set forth in claim 11 wherein one of said tank sections is of dimensions smaller than the dimensions of the other tank section and adapted to fit within said other tank section for transport.

14. A tank structure as set forth in claim 11 wherein a pair of interfitting tank sections are positioned between said pair of parallel tank sections closely adjacent said wellhead.

15. A tank structure as set forth in claim 14 wherein said interfitting tank sections have angle-shaped extensions along opposed sides thereof in interfitting relation with the adjacent opposed sides of said parallel tank sections.

16. A method of catching and containing leaked fluids from a wellhead for an oil and gas well and having a well rig with a derrick having extensible legs positioned adjacent the wellhead for drilling or workover operations; said method comprising the following steps:

positioning a portable tank structure about the wellhead for surrounding the wellhead beneath the rig platform to receive fluids leaked from the wellhead;

positioning a pipe support within the tank structure on a side thereof opposite the well rig; and positioning the extensible legs of said derrick within said portable tank structure.

17. The method as set forth in claim 16 further including the step of positioning a waterproof skirt about the wellhead for surrounding the wellhead above the tank structure for directing fluids downwardly into the tank structure.

18. The method as set forth in claim 16 further including the step of removably positioning a splash board within the tank structure adjacent the pipe support for deflecting fluid from the lower open ends of pipe sections removed from the well into the tank structure.

19. The method as set forth in claim 18 further including the steps of:

providing waterproof splash curtains alongside said tank structure on sides thereof adjacent said splash board for deflecting fluids downwardly into said tank structure; and suspending said splash curtains from the rig platform for extending downwardly to said tank structure.

20. A method of positioning a portable tank structure on the ground surface about a wellhead for an oil or gas well adjacent a well rig for catching and containing leaked fluids from the wellhead; said method comprising the following steps:

providing at least a pair of tank sections with each tank section having a bottom supported on the ground surface and connected sides extending upwardly from the bottom;

placing the tank sections on opposite sides of said wellhead in generally parallel relation to each other beneath the rig platform; and detachably connecting said tank sections to each other for surrounding the wellhead.

21. The method as set forth in claim 20 further including the step of:

positioning a waterproof skirt about the wellhead above the tank sections for directing fluid leaked from the wellhead into the tank sections.

22. The method as set forth in claim 20 further including the step of:

positioning a pipe support in the tank section opposite the well rig to support pipe sections removed from the well.

23. The method as set forth in claim 22 further including the step of:

removably positioning a splash board on the tank section for the pipe support for deflecting fluids from the lower open ends of pipe sections removed from the well.

24. The method as set forth in claim 23 further including the steps of:

providing waterproof splash curtains alongside said tank sections on sides thereof adjacent said splash board for deflecting fluid downwardly into said tank sections; and suspending said splash curtains from the rig platform for extending downwardly to said tank sections.

25. Apparatus associated with an oil and gas well rig for catching and containing leaked fluids from a wellhead comprising:

a tank structure surrounding the wellhead at a location beneath the rig platform to receive fluids leaked from the well and having a portion positioned adjacent the rig;

a pipe support for pipe sections removed from the well positioned within the tank structure on a side thereof opposite the well rig to support pipe sections removed from the well; and a splash board extending from the tank structure on the side thereof adjacent said pipe support for deflecting fluids draining from the lower open ends of the pipe sections into the tank structure;

said tank structure comprising a pair of generally parallel tank sections on opposed sides of said wellhead, and a pair of cover sections extending between and connecting said tank sections on other sides of said wellhead adjacent said opposed sides thereby to permit said tank structure to surround said wellhead.

26. Apparatus as set forth in claim 25 wherein said cover sections are generally of an inverted V-shape in cross section to provide downwardly sloping surfaces for directing fluid into said tank sections.

27. Apparatus associated with an oil and gas well rig for catching and containing leaked fluids from a wellhead comprising:

a tank structure surrounding the wellhead at a location beneath the rig platform to receive fluids leaked from the well and having a portion positioned adjacent the rig;

a pipe support for pipe sections removed from the well positioned within the tank structure on a side thereof opposite the well rig to support pipe sections removed from the well; and a splash board extending from the tank structure on the side thereof adjacent said pipe support for deflecting fluids draining from the lower open ends of the pipe sections into the tank structure;

said tank structure including a pair of generally parallel tank sections positioned in spaced side-by-side relation on opposed sides of said wellhead, and means detachably connecting said tank sections to each other.

28. Apparatus as set forth in claim 27 wherein said means detachably connecting said tank sections to each other comprises a pair of laterally adjustable interfitting flanges on said tank sections to space said tank sections from each other a predetermined distance.

29. Apparatus as set forth in claim 28 wherein said tank sections have cutout portions to receive said wellhead.

30. A tank structure for receiving and containing leaked fluids from a wellhead having a well rig positioned adjacent the wellhead; said tank structure comprising:

at least a pair of generally parallel portable tank sections positioned on opposed sides of said wellhead; and means detachably connecting said tank sections to each other for surrounding said wellhead, said means detachably connecting said tank sections to each other being adjustable in a lateral direction to connect tank sections spaced at various lateral distances from each other to permit utilization of said tank sections with wellheads of various shapes and sizes.

31. A tank structure as set forth in claim 30 wherein said means detachably connecting said tank sections to each other comprises a pair of cover sections extending between said tank sections and being of an inverted V-shape in cross section to provide downwardly sloping surfaces for directing fluid into said tank sections.

32. A tank structure as set forth in claim 30 wherein said tank sections have inner opposed vertical sides spaced from each other and one of said tank sections has an upper horizontal flange extending from its inner side over the inner side of the other tank section to cover the space between said tank sections.

* * * * *